US007769485B2

(12) United States Patent
Miller et al.

(10) Patent No.: US 7,769,485 B2
(45) Date of Patent: Aug. 3, 2010

(54) SYSTEMS AND METHODS FOR SEGREGATING UNDESIRED MAIL

(75) Inventors: John P. Miller, Shelton, CT (US); Luis A. Sanchez, Troy, NY (US); George M. MacDonald, New Canaan, CT (US)

(73) Assignee: Pitney Bowes Inc., Stamford, CT (US)

( * ) Notice: Subject to any disclaimer, the term of this patent is extended or adjusted under 35 U.S.C. 154(b) by 169 days.

(21) Appl. No.: 11/864,991

(22) Filed: Sep. 29, 2007

(65) Prior Publication Data

US 2009/0084713 A1 Apr. 2, 2009

(51) Int. Cl.
*B65H 1/08* (2006.01)

(52) U.S. Cl. ..... 700/224; 209/38

(58) Field of Classification Search ..... 700/224, 700/223, 219, 221; 209/38
See application file for complete search history.

(56) References Cited

U.S. PATENT DOCUMENTS

| | | | | |
|---|---|---|---|---|
| 5,648,916 | A * | 7/1997 | Manduley | 700/90 |
| 5,667,078 | A * | 9/1997 | Walach | 209/584 |
| 6,196,393 | B1 | 3/2001 | Kruk, Jr. et al. | 209/630 |
| 6,557,755 | B1 | 5/2003 | Pickering, Jr. et al. | 235/376 |
| 7,161,108 | B2 | 1/2007 | O'Connell et al. | 209/584 |
| 2003/0122086 | A1* | 7/2003 | Ryan et al. | 250/455.11 |
| 2003/0163421 | A1 | 8/2003 | Van Ness et al. | 705/40 |
| 2004/0031846 | A1 | 2/2004 | Burgess | 235/375 |
| 2004/0064422 | A1 | 4/2004 | Leon | 705/401 |
| 2004/0073617 | A1* | 4/2004 | Milliken et al. | 709/206 |
| 2004/0193721 | A1* | 9/2004 | Takayama et al. | 709/229 |
| 2005/0144145 | A1 | 6/2005 | Ogg et al. | 705/404 |
| 2005/0198579 | A1* | 9/2005 | Perepa et al. | 715/752 |
| 2005/0210272 | A1* | 9/2005 | Fotta | 713/188 |
| 2006/0089921 | A1 | 4/2006 | Witmond et al. | 705/401 |
| 2007/0135963 | A1 | 6/2007 | Fogel et al. | 700/227 |

OTHER PUBLICATIONS

Printed Literature: Pitney Bowes Inc., "Olympus® II Incoming Mail Sorting Solution. Putting Your Mail to Work with Speed and Precision." Date.
Printed Literature: Pitney Bowes Inc., "Olympus® II Incoming Mail Sorting Solution. Putting Your Mail to Work with Speed and Precision." Date.
U.S. Appl. No. 11/588,058, filed Oct. 26, 2006, R. Heiden et al.
U.S. Appl. No. 11/648,416, filed Dec. 29, 2006, A. Parkos et al.
U.S. Appl. No. 11/755,633, filed May 30, 2007, J. Sussmeier et al.
Printed Literature: Pitney Bowes Inc., "ImageAlert™ Mail Verification System." 2002.
Printed Literature: Pitney Bowes Inc., "Arrival® Package Tracking and Delivery Management System." Sep. 25, 2007.

* cited by examiner

*Primary Examiner*—Patrick Mackey
*Assistant Examiner*—Michael E. Butler
(74) *Attorney, Agent, or Firm*—George M. Macdonald; Angelo N. Chaclas

(57) ABSTRACT

Systems and methods for optimizing the process of segregating undesired mail using an incoming mail sorter are described and in certain examples, systems including those for using information feed-forward and/or feedback systems for making selective physical delivery decisions in the process of sorting and delivering incoming physical mail are described.

5 Claims, 5 Drawing Sheets

DATABASE COMPARISON AND ACCEPTANCE
USER MAIL ACCEPTANCE
DATABASE
530
532
534
540
544
546
542
ACCEPTABLE MAIL
MAIL TO TRASH OR SHRED
MAIL DIVERTER
MAIL SEGREGATION
BARCODE &/OR OCR IMAGE ANALYSIS
IMAGE CAPTURE AND ANALYSIS
BARCODE SCANNER &/OR CAMERA
MAIL FEEDER
510
520
500
MAIL PIECES

SYSTEMS AND METHODS FOR SEGREGATING UNDESIRED MAIL

FIELD OF THE INVENTION

The illustrative embodiments described in the present application are useful in systems including those for optimizing the process of segregating undesired mail and more particularly are useful in systems including those for using information feed-forward and/or feedback systems for making selective physical delivery decisions in the process of sorting and delivering incoming physical mail.

BACKGROUND

Commercial automated incoming mail sorters are available and employed in the mailrooms of many large corporations. For example, the OLYMPUS II incoming mail sorter is available from Pitney Bowes Inc. of Stamford Conn. In such a system, incoming mail is fed into the sorting system that includes a subsystem for identifying the intended recipient in the particular organization. For example, an Optical Character Recognition process may be used to read the name of the intended recipient. The system may then search a database for the mail stop location associated with that intended recipient. Such systems utilize other subsystems and processes for determining the intended recipient and may also mark the mail piece with a code that provides information such as destination information. The system will typically employ a loop feed mechanism for moving mail pieces and a number of sort bins for output. A fully configured system may include 480 pockets or sort bins in multiple tiers and is capable of processing 36,000 letters per hour.

In a typical large company mailroom, a good deal of effort and significant amount of time is devoted to sorting through unsolicited mail. Since much of the unsolicited mail is also undesired and may go unopened and unread, such mail may waste the time of the mailroom employee and the intended recipient.

Advertising mail including direct mail advertising mail pieces is employed as a marketing tool by businesses around the country and is an important part of the mailstream. Direct Mail campaigns are often considered successful if they achieve at least a 2% response rate. Additionally, there is a current trend of decreasing single-piece first class mail volumes in the United States with some increase in presort and automation mail categories that are frequently used by direct mail advertisers. Mailroom employees may spend 25% or more of their time sorting Standard Class advertising mail. Accordingly, in a large corporate mailroom, there may be a significant percentage of advertising mail in the incoming mailstream. There has not been available an efficient system for selectively deciding whether to physically deliver certain suspected advertising mail using feed-forward or feedback systems. For example, an intended recipient may receive many pieces of mail in a daily or more frequent mail delivery when received from the centralized mailroom staff. The recipient then must sort through the mail to prioritize time-sensitive business communication. A particular recipient may put aside advertising mail for consideration at a convenient time. Additionally, since direct advertising mail response rates are typically at a 2% level, much of the advertising mail will be discarded locally either in an opened or unopened state. Then, custodial staff will typically be required to collect the discarded advertising mail and redeliver it to a central location such as for recycling or trash pickup.

Accordingly, there is a need to provide greater efficiency in processing incoming mail in order to provide greater efficiencies for mailroom staff and the intended recipients of the mail. There is a need for systems and processes that analyze the incoming mailstream and that use information to provide more efficient processing.

The mailroom staff working in certain corporate mailrooms may employ a drastic mail delivery reduction policy of discarding certain types of mail as a matter of course without determining the intended recipient (or a successor individual). For example, all non-profit mail is discarded at some corporate mailrooms. Certain companies may discard presorted mail such as presorted standard mail. However, first class mail is also often presorted and may include relatively important communications. Additionally, even though the USPS requires that personal information be mailed using first class service, it is possible that certain important information could be included in a standard class mailing. Accordingly, there is a need to reduce distribution of undesired mail without discarding relatively more important mail pieces.

Depending on the incoming mail sorting capability of a company, it may be possible to employ differing incoming mail delivery schedules based upon criteria such as the class of mail (e.g., first class compared with standard mail) or the type of mail (e.g., periodicals compared with letters). For example, standard class mail may be delivered only once per week (e.g., Friday). However, different individuals in the organization may have different schedules and mailroom capacity varies. Accordingly, there is a need to allow selective delayed delivery of incoming mail.

SUMMARY

The present application describes illustrative embodiments of systems and methods for optimizing the process of segregating undesired mail and in certain illustrative examples, describes systems and methods including those for using information feed-forward and/or feedback systems for making selective physical delivery decisions in the process of sorting and delivering incoming physical mail.

In one illustrative example, a process for selective physical delivery of mail using aggregation of mass mailings and a feed-forward information process is described to provide efficient individualized selective physical delivery. An incoming mass mailing is aggregated and then enhanced information is electronically delivered to each recipient in order to allow each recipient make a selective physical delivery decision. In another illustrative example, a process for selective delayed physical delivery of low priority mail pieces is described to efficiently use mailroom resources and to allow an opt-in priority change. In yet another illustrative example, a system and process for selective physical delivery of mail using physical feedback information is provided to provide efficient selective delivery of mail pieces.

BRIEF DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION

The illustrative embodiments of the present application describe systems and methods including those that are useful for optimizing the process of segregating undesired mail and more particularly are useful in systems including those for using automated incoming mail sorters with information feed-forward and/or feedback systems for making selective physical delivery decisions in the process of sorting and delivering incoming physical mail. For illustrative purposes, the mail carrier described is the United States Postal Service (USPS).

As described herein, it may be possible to identify certain incoming mail as undesired such as by identifying an undesired mail source or some other characteristic of a particular mail piece that enables it to be identified. In a large corporate environment it may be possible to individually define undesirable characteristics by employee and there may be opportunity for group characteristic settings. In one illustrative embodiment, incoming mail is aggregated if included in a mass mailing. The aggregated mass mailing is then processed using feed-forward information systems. Enhanced information is electronically delivered to each recipient in order to allow each recipient make a selective physical delivery decision. In another illustrative embodiment, low priority mail is identified and segregated for delayed delivery in accordance with an intended recipient preference profile. Additionally, opt-in priority changes are utilized.

In yet another illustrative embodiment, a system and process for selective physical delivery of mail using physical feedback information is provided to provide efficient selective delivery of mail pieces. A physical feedback mechanism is employed to determine undesired mail sources. After mail is delivered, a recipient may place undesired mail into a designated undesired source mail. That action instructs the incoming mail room to cull and destroy future correspondence addressed to that recipient from that source. Once identified as an undesired source by the recipient, the system processes the original undesired mail piece in order to recognize similar future mail pieces that are then culled in the mailroom prior to physical delivery. The system may scan the original undesired item for sender information and other envelope markings that can identify future correspondence from this source. Future incoming mail can then be scanned, segregated and culled for duplicate undesirables.

Figure 1A:
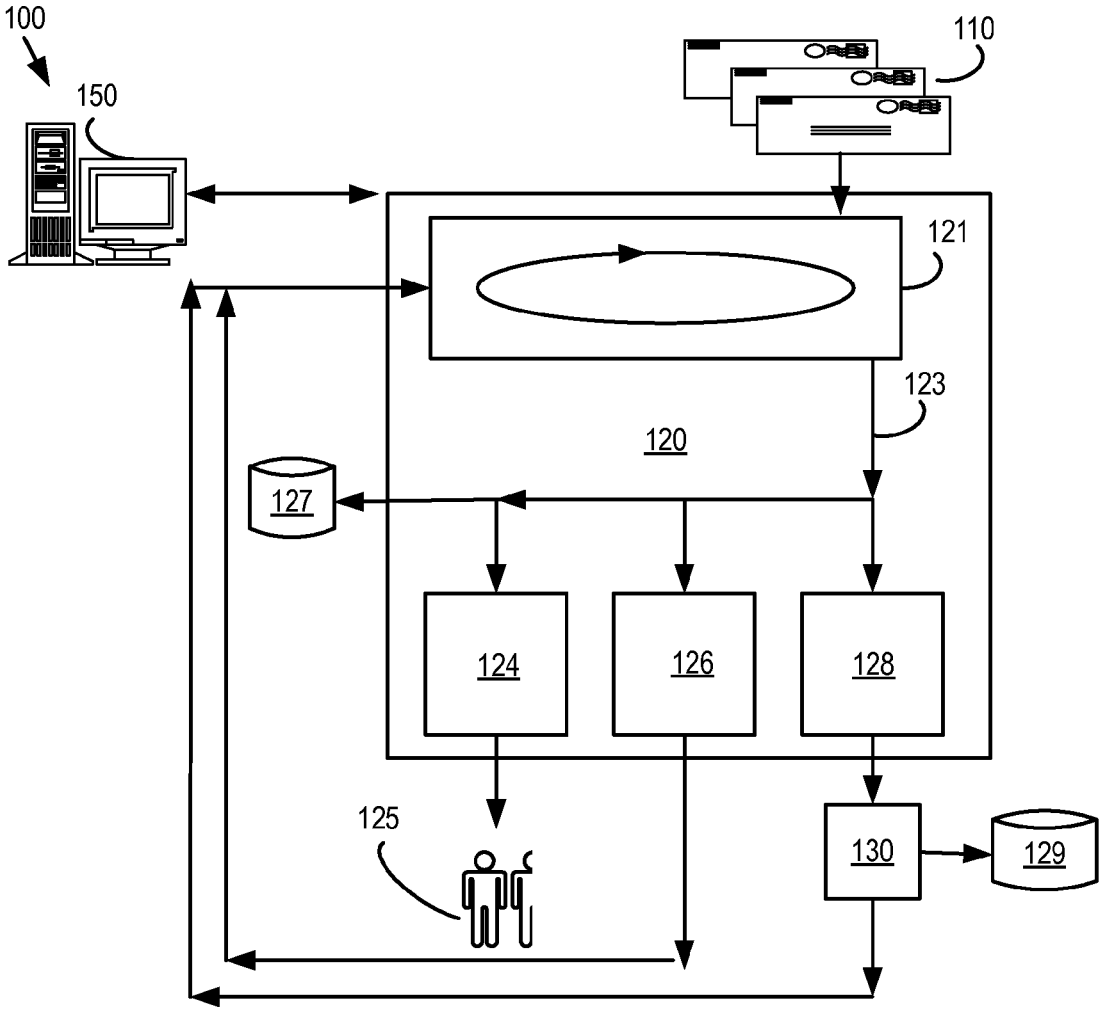
FIG. 1A is a schematic diagram of a system for selective physical delivery of mail according to an illustrative embodiment of the present application.

Referring to FIG. 1, a schematic diagram of a system 100 for facilitating selective delivery of physical mail according to an illustrative embodiment of the present application is shown. Incoming white mail 110 may include many sizes and shapes of envelopes, some of which may have the information as included in representative mail piece 10. Mail 110 is delivered to an incoming mail sorter 120. The incoming mail sorter described here is the OLYMPUS II mail sorter available from Pitney Bowes Inc. of Stamford, Conn. However, other incoming mail sorters may be used and in some processes described herein, manual processing may be performed. While the embodiments described refer to mail pieces and envelopes, other packages may be processed and mail items such as magazines that may not include envelopes may be processed. In such cases, exterior image scans are made of the covers or out box material. The incoming mail sorter includes a relatively long transport path 121 and mail pieces may make more than one pass through the system if they are not deposited in an output bin during the first pass through the system.

In this illustrative embodiment, the sorter system 120 includes the traditional physical mail delivery bins that are organized by mail stop code or other designation 124 for delivery by a mail room worker 125. The system 120 also includes additional sort bins along feed path 123 named the delayed delivery bins 126, the mass mailing bins 128 and the trash bin 127. The mass mailing bins can output back to the incoming mail sorter at 121 or to another sorter 130 for culling into the trash 129 or back into the sorter at 121.

The mail pieces sorted into the delayed delivery bins may be processed on an as soon as practical basis or by desired day. For example, delayed output bins associated with each business day of the week from Monday through Friday may be assigned (e.g., M, T, W, TH, F). The Mass Mailing bins 128 are named MM1 though MMn and are assigned as need to individual mass mailings while they are being processed. The additional sorter may be a table top unit with less functionality than the incoming mail sorter. For example, if the mass mailing is already coded for the intended recipient and also with mass mailing identification information, a table top unit that reads barcodes may be used to cull the mass mailings before the mail pieces to be delivered are sent to the incoming mail sorter for a second pass.

System controller 150 executes the processes described herein and is utilized for sending feed-forward communications described, for processing manually entered and automatically generated physical delivery disposition decision. The system is also utilized for creating and communicating opt-in priority codes that are provided to mass mailers to change a priority setting.

Systems and methods have been described for using incoming mail sorters in a process for digitizing and electronically delivering incoming mail. U.S. Pat. No. 7,161,108 B2, issued Jan. 9, 2007 to O'Connell, et al. describes systems and methods for routing imaged documents, which is incorporated herein by reference in its entirety. The ARRIVAL system available from Pitney Bowes Inc. of Stamford, Conn. may be utilized to track incoming mail after it leaves the mailroom. The IMAGEALERT MAIL VERIFICATION system, also available from Pitney Bowes Inc., may be utilized to screen incoming packages. A mailroom employee may use the system to capture a digital image of a package and then email that image to the intended recipient in order to request delivery instructions. In alternative embodiments, the embodiments described herein may additionally and/or alternatively utilize the systems and methods of those products.

In alternative embodiments, the embodiments described herein may additionally and/or alternatively utilize the systems and methods for processing digitized mail described in commonly-owned, co-pending U.S. patent application Ser. No. 11/588,058, entitled "Intelligent Physical Mail Method and System," filed Oct. 26, 2006, by Heiden, et al. and commonly-owned, co-pending U.S. patent application Ser. No. 11/648,416, entitled "System And Method For Delivering Digitized Mail," filed Dec. 29, 2006, by Parkos et al. which are both incorporated herein by reference in their entirety. For example, in an alternative applicable to any of the embodiments herein, the intelligent agent computer system described in the incorporated application performs supervised or directed learning of the delivery preferences for a recipient or group of recipients in order to make physical delivery disposition determinations.

The OLYMPUS II can be used to determine an intended recipient and to print encoded information including destination recipient information or a reference to such information. Thereafter, that code can be more easily read by downstream equipment for processing and accordingly, the downstream equipment would not be required to independently determine the intended recipient such as by OCR processing. The mail designated for destruction may be saved for a period of time so that any user may find such mail if necessary.

Figure 1B:
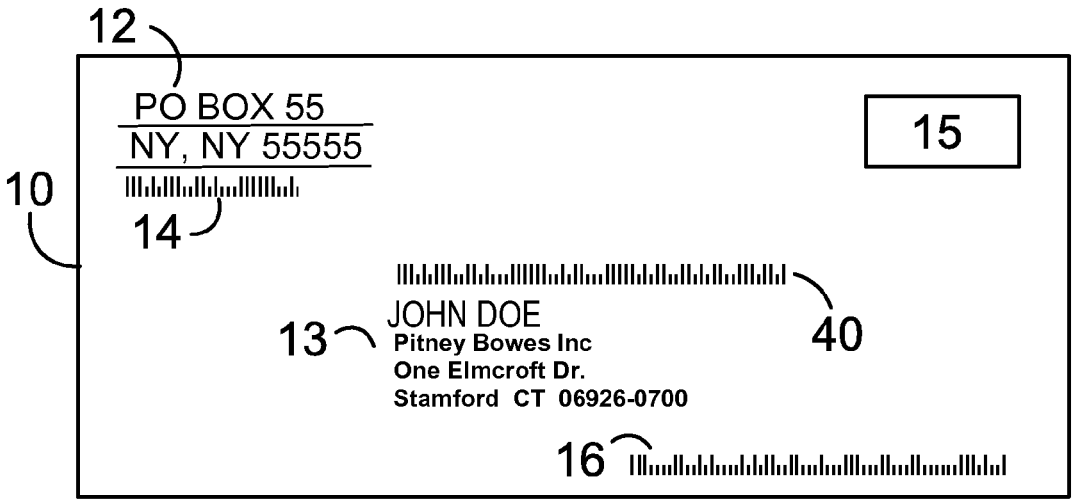
FIG. 1B is a schematic diagram of a representative incoming mailpiece according to an illustrative embodiment of the present application.

Referring to FIG. 1B, a representative mail piece 10 is shown. The mail piece includes a return address 12 that may not specifically name the sender. However, the return address may be useful in identifying a sender or at least associating a mail piece with a particular mass mailing. The postal block 15 may include a postal indicia, a permit mail block or a stamp. The system may determine a class of mail by imaging this block and use such information to characterize standard or non profit mail as low priority. Similarly, presort mail may be initially characterized as low priority. The address block 13 may be processed in the incoming mail sorter using OCR to identify an intended recipient. The intended recipient identity could then be encoded on the mail piece in addition to other information such as sender related information. Such information could be printed using another barcode on the envelope (not shown). Here, mail piece 10 includes a POSTNET code 16 to provide zip code and delivery point information typically associated with an individual mailing address.

Also, this mail piece includes a PLANET code 40 that may be useful in identifying mass mailings as described below. Typical mass mailers presort thousands or tens of thousands of mail pieces into an outgoing mass mailing. The mass mailing campaign may comprise direct advertising mail and may be sent using the USPS standard mail service. Additionally, large companies such as credit card companies or utility companies may have large mass mailings of statements that may be sent using first class mail service, but also utilizing presort discounts. Typically, mail including personal information must be sent using first class service. The mass mailers may use a PLANET code as a quality of service (QOS) or mass mailing identification/tracking code. The PLANET code utilizes a defined format and a registration authority ensures that the codes used by individual mass mailers do not overlap so that they are sufficiently unique during a relevant period. Typically, the same PLANET code is applied to each mail piece in a mass mailing. Together with the POSTNET code, the two codes provide fairly effective identification of a mail piece.

The encoded information applied to a mail piece by the incoming mail sorter may include intended recipient information such as identity and location (or reference to such information). Additionally, the encoded information applied by the sorter may include information regarding the particular sender or a particular mailing campaign. Furthermore, the encoded information may include information regarding a non-specific sender or mailing campaign that can be used to associate multiple mail pieces in the incoming mail stream. The encoded information may be printed on the mail piece envelope as a 1D or 2D barcode, or even as multiple barcodes. PLANETCODE and POSTNET code 1-D symbologies and data formats may be used as well as 4-state 1-D barcode symbology and data format. Other appropriate information bearing indicia and data formats may also be utilized including known machine readable symbologies and/or alphanumeric text that may be human and machine readable. As can be appreciated from studying the teachings herein, sender or mailing campaign information may be present on a received mail piece, but might not be in a format easily read by equipment located downstream of an incoming mail sorter.

Figure 2:
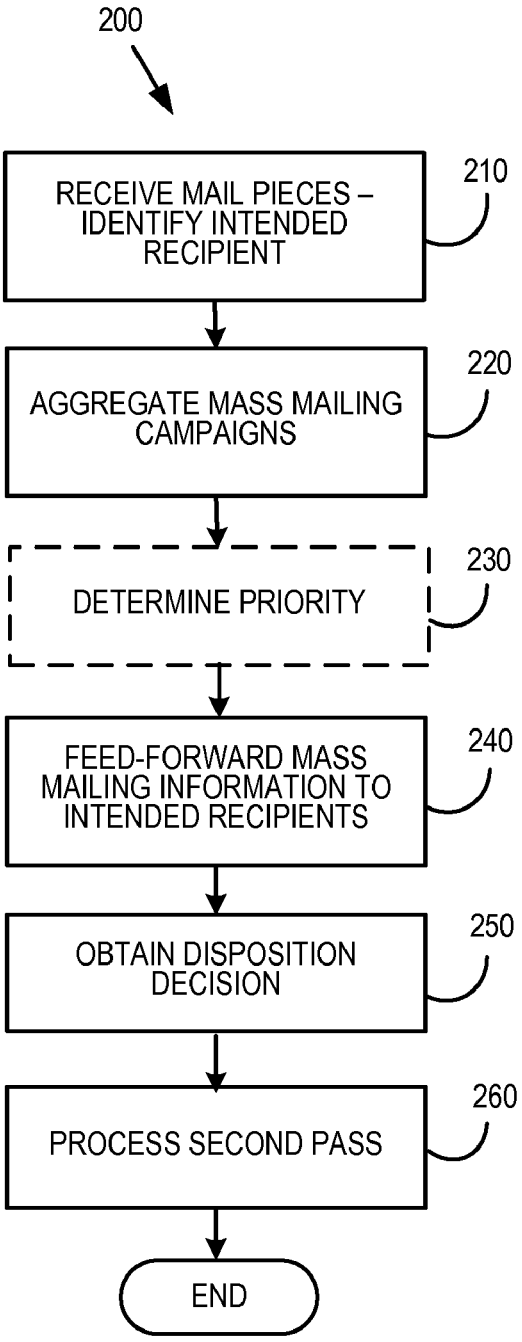
FIG. 2 is a flow chart describing a process for selective physical delivery of mail using aggregation of mass mailings and a feed-forward information process according to an illustrative embodiment of the present application.

Referring to FIG. 2, a flow chart describing a process 200 for selective physical delivery of mail using aggregation of mass mailings and a feed-forward information process according to an illustrative embodiment of the present application is shown. When mail arrives in a mailroom, it is fed into an incoming mail sorter, that may individually identify each mail piece with a unique identifier.

In step 210, the incoming mail sorter 120 is used to process a batch of mail received from the mail carrier and to identify the intended recipient of each mail piece. The incoming mail sorter may also print a code identifying the intended recipient so that downstream equipment may use the information without necessarily performing the address block Optical Character Recognition OCR or other process necessary to identify the intended recipient. In step 215, the sorter performs the incoming mail destination determination. If the incoming mail sorter can make a destination determination, it associates a physical and electronic destination address with the recipient. If the system cannot make an automated intended recipient/destination determination, it then uses the traditional incoming mail sorting methods to make that determination such as remote operator visual encoding or out-sorting for manual processing.

In step 220, the incoming mail sorter 120 is used to aggregate a mass mailing by identifying mail pieces associated with a mass mailing and sorting those mail pieces to a selected output bin associated with the mass mailing. Mail may be aggregated using several data points that may identify each mail piece as a part of a particular mass mailing. In particular, the incoming mail sorter 120 may scan a particular return address to identify a particular sender or an association with an unspecified sender. An arbitrary sender identifier can be associated with a particular return address if necessary until additional information may be determined to further clarify the identity of the sender. If a postal indicia is utilized, the sender may be identified by noting the meter serial number and determining if the meter is used by a particular sender. If the identity of the sender was not readily apparent, the identity of such a particular sender could then be associated with that meter serial number after the mail piece is opened. The meter serial number could thereafter be used to identify that sender until conflicting information was obtained.

Additionally, the incoming mail sorter 120 may scan for identical PLANET codes. A mass mailer will often place the same PLANET code on each mail piece in a mass mailing for using in tracking the mail piece and monitoring performance. Accordingly, the first time a mail piece with a particular PLANET code is scanned, it may be logged and routed to the intended recipient, or it may be put in rotation 121 in the circular path of the incoming mail sorter to provide some delay to determine if the same PLANET code is found in a subsequent mail piece. If the PLANET code is detected at least twice, that PLANET code is assigned a Mass Mailing code and all mail pieces with the same PLANET code are routed to the mass mailing output bin associated with that mass mailing campaign. As shown in FIG. 1B, the PLANET code 40 may be easily scanned and decoded using an appropriate 1-D barcode scanner.

Furthermore, it may one day be common to identify a mass mailing by scanning a voluntarily applied code that identifies a sender, a particular mailing campaign and perhaps the type of contents in the mail piece. Accordingly, the system may be configured to scan for a code identifying a sender or mass mailing campaign.

Certain mass mailings may be difficult to automatically associate with each other using the incoming mail sorter due to the lack of a return address, a PLANET code or other identifying information. However, since mass mailings are often delivered to a single address as a presorted batch by the postal service, an alternative approach is possible. In such cases of a mass mailing received in aggregated form, the incoming mail sorter 120 is switched into mass mailing process mode. A mailing campaign code is manually or automatically assigned to the pending batch of mass mail. The batch of mail is then fed through the incoming mail sorter in mass mailing mode. The incoming mail sorter 120 processes the individual mail pieces to identify the intended recipient. The intended recipient information may be printed on the mail piece as well as a code identifying the mailing. Each mail piece in that mass mailing batch is then routed to an output bin associated with that mass mailing and the aggregate are processed using the feed-forward information system and methods described above.

In optional step 230, information regarding the priority of the mail pieces in the particular mailing campaign is determined and if the items are of a relatively high priority (e.g., billings statements that happened to be mass mailed) they are placed back into the sorter for physical routing to the intended recipient. If the mass mailing is determined to include relatively lower priority items such as direct advertising mail, the process continues. In one alternative, if the mass mailing is determined to include relatively low priority items, they are discarded.

In step 240, information regarding the mailing campaign is fed-forward to each intended recipient identified by the incoming mail sorter. For example, an image of the face of the mail piece (or a representative mail piece in the mass mailing) may be forwarded to the intended recipient. If the sender has been automatically identified (or even the type of mail), then that information may be automatically forwarded to the intended recipients. Optionally, a mail room employee opens a representative mail piece from the mail piece and creates a mass mailing record that is sent to each of the intended recipients. The record may include information such as the identity of the sender, the type of mail and/or a digital scan of some or all of the mail piece contents.

In step 250, the system then requests a disposition decision from the intended recipients. The decision may be a selection from the intended recipient, an automated response based upon preference criteria or a delay decision based upon information such as received from an out of office agent.

In step 260, the mass mailing is re-processed and physical delivery is selectively determined for each of the intended recipient based upon feedback from the intended recipient, a preference setting or a default value. The mail piece may be selected for immediate physical delivery, may be placed in a delayed delivery bin, or may be discarded.

Figure 3:
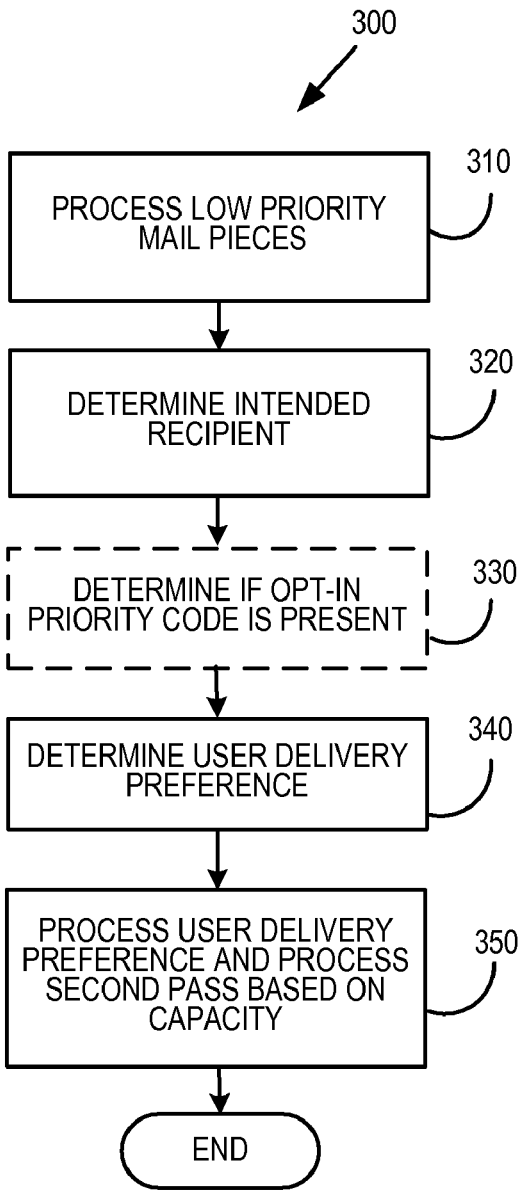
FIG. 3 is a flow chart describing a process for selective delayed physical delivery of low priority mail pieces according to an illustrative embodiment of the present application.

Referring to FIG. 3, a process 300 for selective delayed physical delivery of low priority mail pieces according to an illustrative embodiment of the present application. Some companies discard all standard class or presort mail. Additionally, it may not be convenient for employees to receive advertising mail each day. Furthermore, there may be a need to balance the physical delivery load in a mailroom.

In step 310, all low priority mail is processed by the incoming mail sorter 120. In some circumstances, low priority mail will be defined as all standard class mail and non profit mail. In other cases, all presort mail and media mail will also be included in the low priority definition. The system may OCR the stamp block to determine if a standard class mail or other low priority class such as non profit is being utilized. In step 320, the system determines the intended recipient. In optional step 330, the system determines if an opt-in priority upgrade code is included on the mail piece. If so, the mail piece is routed to the output bin associated with the intended recipient.

In order to prevent unauthorized use of an opt-in code, the code may time-out. Additionally, the code may be cryptographically secured such as by using a public-key cryptography system for authentication. Furthermore, the code may be related to one or more postal permit numbers or postage meter serial numbers so that they would be limited to use by a particular mailer.

In step 340, the system determines whether the user preference is for as soon as practical delivery or for delivery on a particular day and routes the mail piece accordingly. If the mail piece is scheduled for as soon as practical delivery, it is placed in a bin associated with that delivery preference.

In step 350, if the mail piece is scheduled for as soon as practical delivery, the incoming mail sorter processes all incoming mail. If additional delivery capacity exists that day, a second pass is made using the mail pieces in the as soon as practical bin to fill delivery capacity. If a particular day is selected by user preference, the mail is processed in a second pass on that selected day.

The opt-in procedure provided may be advantageous in permitting a first screening using a low cost system to cull mass mailings before they are input to the incoming mail sorter. If a company discards all standard class mail, desired mail pieces may be lost. Similarly, if a company discards all presort mail, credit card statements and utility bills might be discarded. It would be advantageous to minimize the risk of a mailroom discarding important mail. For example, with reference to FIG. 1B, a table top scanning unit could scan for opt-in code 14 and cull any mail piece that is designated low priority but that does not have a valid opt-in code. The company would therefore provide such opt-in codes to mailers that it desired mail from. The opt-in codes can be protected cryptographically such as by public key cryptography including authentication. They may also be protected using time out techniques. For example, a valuable newsletter may be sent via media mail and should not be discarded. If the newsletter included an opt-in code, it would not be culled.

In an embodiment, each employee or a subset of employees may provide profile information regarding desired mailers such as desired mass mailers to system 150. Additionally, certain profile information may be populated automatically by functional or other employee groupings. For example, an opt-in code relating to a computer science newsletter may be populated for each employee engaged in the practice of computer science. A mass mailer may then query a recipient company for opt-in codes and system 150 would provide the codes (there could be a specific code provided for each employee or subset of employees). The mass mailer would then digitally sign the codes and print the code on the appropriate mail piece. In another alternative, a code may be provided that is effective for each employee. When the mass mailing is received, a public key associated with the mass mailer can be used to authenticate the code.

As can be appreciated for reviewing the teachings herein, the opt-in codes described differ from previous applications of opt-in codes in areas such as email in that they do not necessarily limit the mass mailer mailing list. The mass mailer may still send mail without the code, but a mailroom may or may not deliver it. Accordingly, the opt-in code is useful in assisting the sorting of large batches of incoming mail in a corporate environment. In yet another embodiment, the opt-in code provided includes routing or other information that will be used by the incoming mailroom and that is not necessarily discernable to the mass mailer. For example, the opt-in code may identify the mailer. Additionally, the opt-in code may provide routing information for the incoming mail piece. The opt-in code could specify that the particular employee would prefer to receive that mass mailing on a delayed basis or that the employee would like it forwarded to another location. Furthermore, the opt-in code may specify that certain types of incoming mass mailings from that sender still be discarded, while other types are delivered. For example, the opt-in code may specify that presort first class mail from a particular sender be delivered, but that presort standard class mail not be delivered. Other characteristics such as size and weight may be used in such determinations.

In another alternative embodiment, the mail piece 10 includes an encrypted, encoded link to a copy of the contents of the mail piece. For example, code 14 could instead include a small 2-D barcode including encrypted information using the recipient company's public key that provides a URL and password to access a digital copy of the contents of the mail piece. The code also provides authentication information so that the recipient can authenticate the sender as the source of the mailing and the digital link such as by using public key authentication signatures. If a valid code 14 is present, the system 100 processes the mail piece. The system sorts the mail piece to the delayed delivery category and provides the digital content to the user. If the user requests physical delivery, the mail piece is later processed for physical delivery to the intended recipient. In another alternative, each employee may provide a list of desired senders so that mail that can be determined to from one of the senders on the list will be delivered.

Figure 4A:
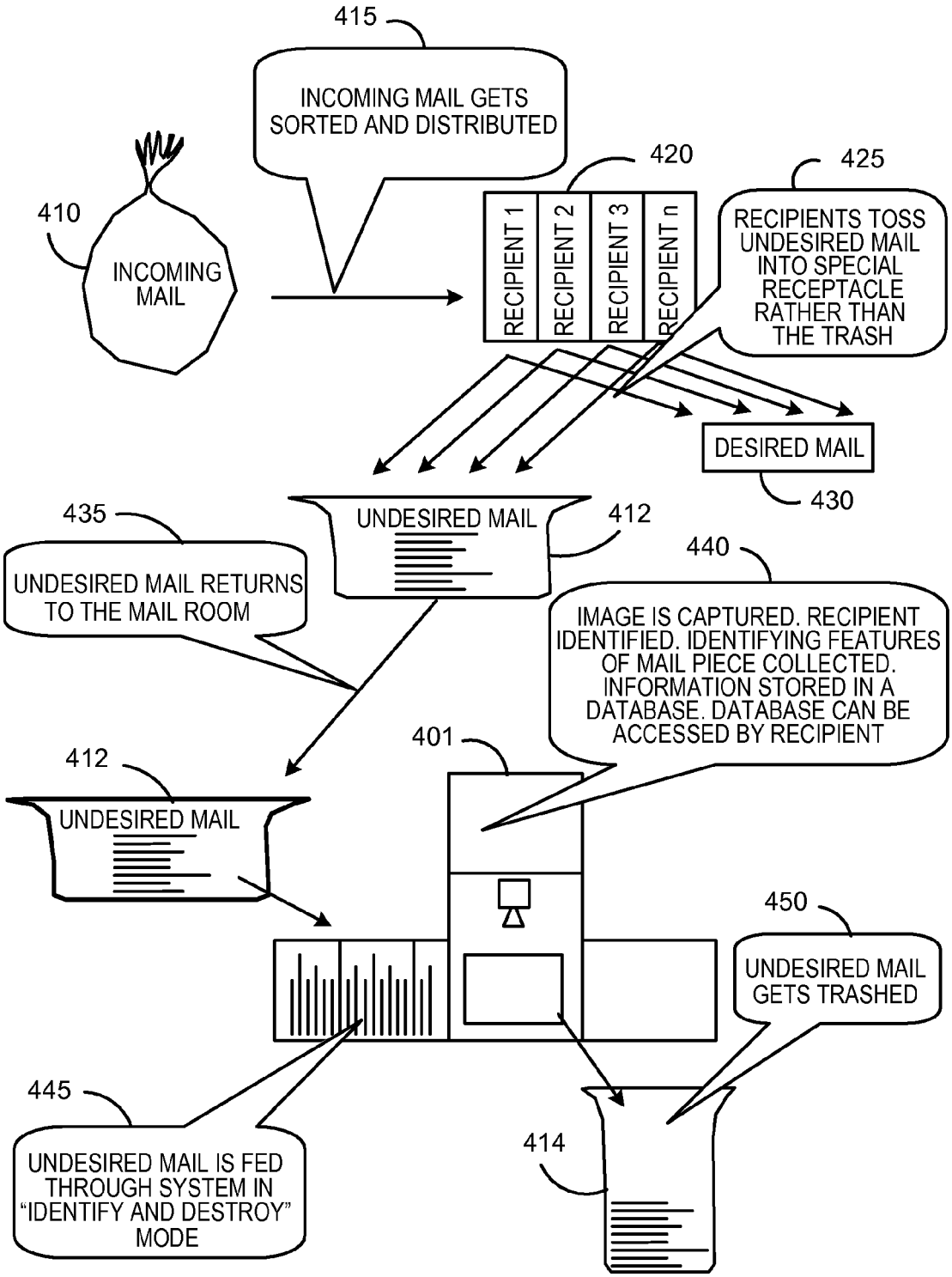
FIGS. 4A and 4B is a schematic describing a system and process for selective physical delivery of mail using physical feedback information according to an illustrative embodiment of the present application.
Figure 4B:
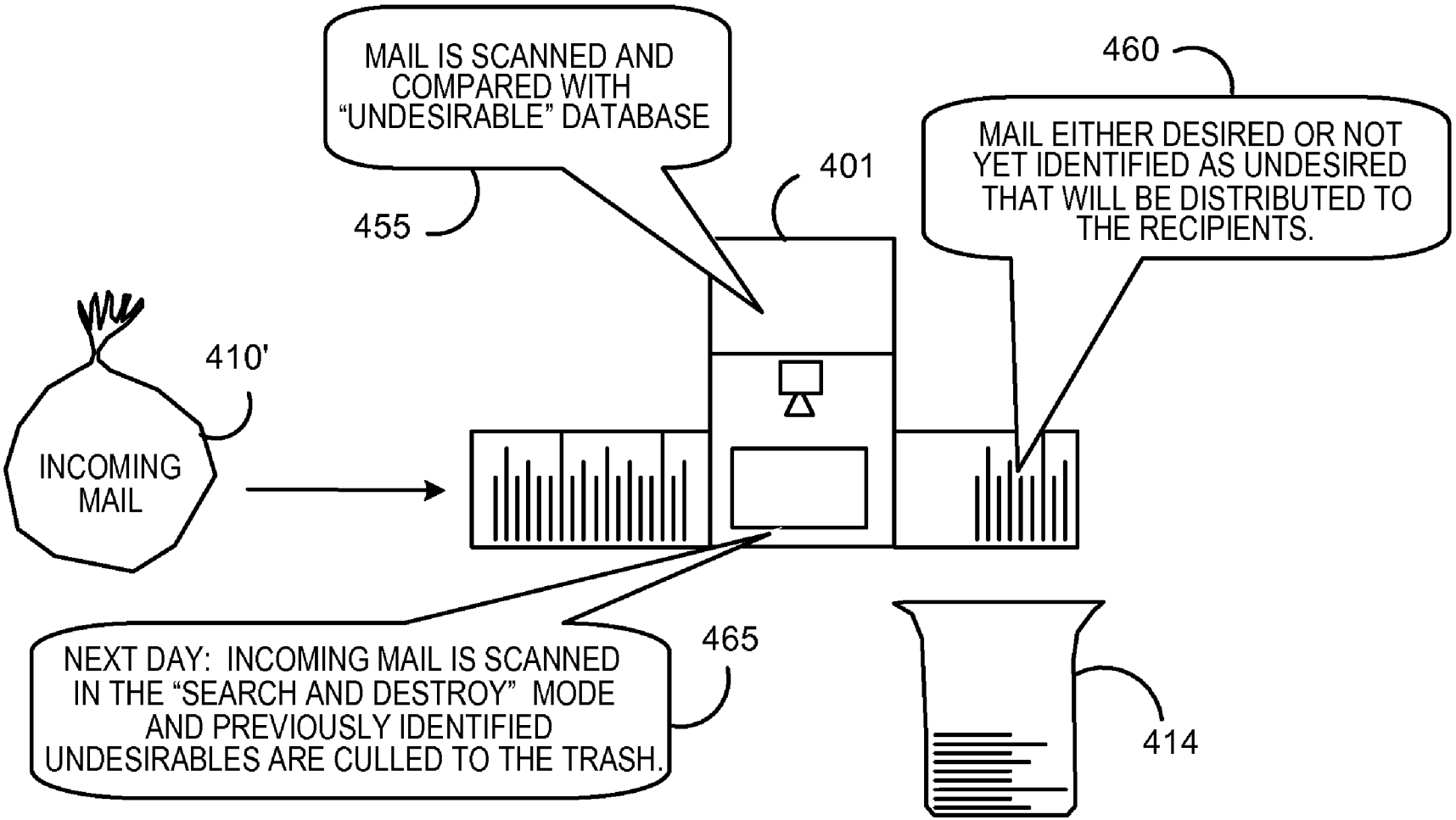

Referring to FIGS. 4A and 4B, a schematic describing a system and process 400 for selective physical delivery of mail using feedback information according to an illustrative embodiment of the present application. A physical feedback mechanism is employed to determine undesired mail sources by providing collection bins for use by the employees. Incoming mail 410 is sorted at 415 into recipient bins 420. After mail is delivered to an employee by the mailroom staff, the employee may keep desired mail 430 or discard undesired mail 425 into a designated undesired source mail bin 412. That action instructs the incoming mailroom to cull and destroy future correspondence addressed to that recipient from that source. Once identified as an undesired source by the recipient, the mail is returned to the mailroom 435 and run through the sorting system 401 when the system is switched into an identify and flag to destroy mode 445 to create a database of undesirable sources.

The undesired mail is then discarded 450 in the trash bin 414. Thereafter, a new batch of incoming mail 401' is received. The mail is scanned and compared with the undesirable database created above 455 using the sorter 410. The sorter is then set to the search and destroy mode in order to cull undesired mail to the trash 465. If the mail has not yet been identified as undesirable, it is delivered 460.

Figure 5:
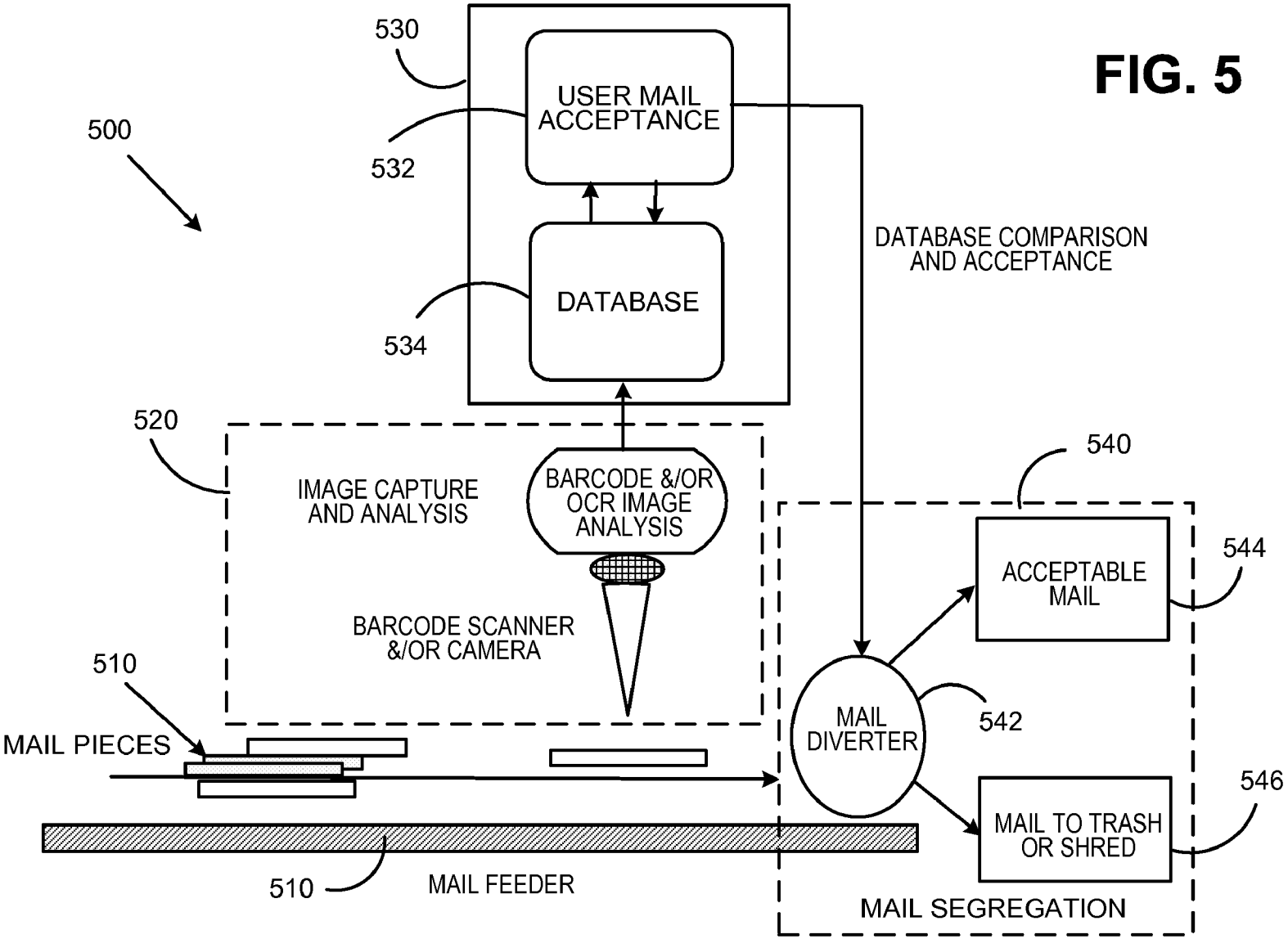
FIG. 5 is a schematic diagram of a system for segregating undesired mail according to an illustrative embodiment of the present application.

Referring to FIG. 5, a schematic diagram of a system 500 for segregating undesired mail according to an illustrative embodiment of the present application is shown. The mail feeder 501 singulates and feeds mail pieces through an image capture and analysis module 520 that includes a barcode and/or OCR/Image analysis processor. A processor 530 includes a database 534 and user mail acceptance logic 532 to perform a decision analysis of whether the mail is culled to trash or delivered. The mail segregator 540 uses that information to trigger the mail diverter 542 and the diverter culls the undesired mail to trash or the shredder 546 or to the acceptable mail bin 544 for further processing. The system 500 if configured with barcode reading capability can be used in the system 100 for subsystem 130.

In another alternative applicable to the embodiments herein, the mail piece sender or a downstream processor may encode source information on the mail piece that would facilitate information capture in the systems described herein. For example, the sender may voluntarily or as mandated by potential regulation, place a barcode on the mail piece identifying information that may include the identity of the sender, a classification of the type of mail, date information, a mail campaign identifier, a URL link to a digital version of the contents and perhaps the identity of the intended recipient.

While illustrative embodiments of the invention have been described above with reference to incoming mail sorters used in corporate campus environments, the illustrative embodiments are not intended to be limiting. For example, the systems and methods described may be employed in other group settings such as at the mailroom of a university or a particular dorm room. Furthermore, the systems and methods described above may be employed by a postal authority where the individual households or individual members of such households are the end recipients.

While illustrative embodiments of the invention have been described and illustrated above, it should be understood that these are exemplary of the invention and are not to be considered as limiting. Additions, deletions, substitutions, and other modifications can be made without departing from the spirit or scope of the present invention. Accordingly, the invention is not to be considered as limited by the foregoing description.

We claim:

1. A method for segregating low priority incoming mail addressed to a plurality of recipients using an incoming mail sorter having a plurality of output bins including an output bin associated with an intended recipient and at least one output bin assigned for delayed delivery comprising:

receiving a batch of incoming mail including a plurality of mail pieces;

processing the batch of mail using the incoming mail sorter, and determining intended recipient information for at least one of the plurality of mail pieces, determining priority information for at least one of the plurality of mail pieces, wherein the at least one of the plurality of mail pieces satisfies low priority criteria:

obtaining low priority incoming mail preference data associated with the intended recipient;

routing the at least one mail piece to either the output bin associated with the intended recipient or the least one output bin assigned for delayed delivery in accordance with the low priority incoming mail preference data;

determining a delivery date associated with the least one output bin assigned for delayed delivery; and on the delivery date, using the incoming mail sorter to reprocesses the at least one mail piece and routing the at least one mail piece to the output bin associated with the intended recipient.

2. The method of claim 1, wherein, the at least one output bin assigned for delayed delivery includes at least one output bin associated with each business day of a week.

3. The method of claim 2, wherein, the preference data is utilized to route the at least one mail piece to the output bin associated with the appropriate business day of the week, and wherein the plurality of recipients have individual preference data.

4. A method for segregating low priority incoming mail addressed to a plurality of recipients using an incoming mail sorter having a plurality of output bins including an output bin associated with an intended recipient and at least one output bin assigned for delayed delivery comprising:

receiving a batch of incoming mail including a plurality of mail pieces;

processing the batch of mail using the incoming mail sorter, and determining intended recipient information for at least one of the plurality of mail pieces, determining priority information for at least one of the plurality of mail pieces, wherein the at least one of the plurality of mail pieces satisfies low priority criteria;

obtaining low priority incoming mail preference data associated with the intended recipient;

routing the at least one mail piece to either the output bin associated with the intended recipient or the least one output bin assigned for delayed delivery in accordance with the low priority incoming mail preference data; wherein:

the preference data varies with the schedule of the intended recipient.

5. A method for segregating low priority incoming mail addressed to a plurality of recipients using an incoming mail sorter having a plurality of output bins including an output bin associated with an intended recipient and at least one output bin assigned for delayed delivery comprising:

receiving a batch of incoming mail including a plurality of mail pieces;

processing the batch of mail using the incoming mail sorter, and determining intended recipient information for at least one of the plurality of mail pieces, determining priority information for at least one of the plurality of mail pieces, wherein the at least one of the plurality of mail pieces satisfies low priority criteria;

obtaining low priority incoming mail preference data associated with the intended recipient;

routing the at least one mail piece to either the output bin associated with the intended recipient or the least one output bin assigned for delayed delivery in accordance with the low priority incoming mail preference data;

wherein determining the mass mailing associated with the mail piece comprises obtaining an opt-in code from the mail piece; further comprising:

cryptographically authenticating the opt-in code obtained from the mail piece.

* * * * *